US009429380B1

(12) United States Patent
Morrison

(10) Patent No.: US 9,429,380 B1
(45) Date of Patent: Aug. 30, 2016

(54) FIREARM SUPPRESSOR WITH A HEAT ANODIZATION TREATMENT

(71) Applicant: Robert Scott Morrison, Hoschton, GA (US)

(72) Inventor: Robert Scott Morrison, Hoschton, GA (US)

( * ) Notice: Subject to any disclaimer, the term of this patent is extended or adjusted under 35 U.S.C. 154(b) by 0 days.

(21) Appl. No.: 14/228,683

(22) Filed: Mar. 28, 2014

Related U.S. Application Data

(60) Provisional application No. 61/836,508, filed on Jun. 18, 2013, provisional application No. 61/872,012, filed on Aug. 30, 2013, provisional application No. 61/892,070, filed on Oct. 17, 2013, provisional application No. 61/892,087, filed on Oct. 17, 2013.

(51) Int. Cl.
*F41A 21/30* (2006.01)

(52) U.S. Cl.
CPC ..... *F41A 21/30* (2013.01)

(58) Field of Classification Search
CPC ..... F41A 21/30
USPC ..... 181/223; 89/14.4
See application file for complete search history.

(56) References Cited

U.S. PATENT DOCUMENTS

| | | | |
|---|---|---|---|
| 825,010 | A | 7/1906 | Snow |
| 1,017,003 | A | 2/1912 | Kenney |
| 1,111,202 | A | 9/1914 | Westfall |
| 1,127,250 | A | 2/1915 | Humm |
| 1,482,805 | A | 2/1924 | Maxim |
| 1,747,876 | A | 2/1930 | Metzgar |
| 1,860,276 | A | 5/1932 | De Luce et al. |
| 1,939,700 | A | 12/1933 | Hofstetter |
| 2,780,962 | A | 2/1957 | Ressler et al. |
| 2,792,760 | A | 5/1957 | Hammer |
| 3,385,164 | A | 5/1968 | Karl-Heinz Walther et al. |
| 4,291,610 | A | 9/1981 | Waiser |
| 4,530,417 | A | 7/1985 | Daniel |
| 4,576,083 | A | 3/1986 | Seberger, Jr. |
| 4,584,924 | A | 4/1986 | Taguchi |
| 4,588,043 | A | 5/1986 | Finn |
| 4,869,151 | A | 9/1989 | Chahin |
| 4,907,488 | A | 3/1990 | Seberger, Jr. |
| 4,974,489 | A | 12/1990 | Fishbaugh |
| 5,029,512 | A | 7/1991 | Latka |

(Continued)

FOREIGN PATENT DOCUMENTS

| | | |
|---|---|---|
| GB | 2281119 | 2/1995 |

OTHER PUBLICATIONS

"SilencerTalk" messageboard; "Things to come . . . " thread; Jul. 27, 2009-Aug. 1, 2009; <http://www.silencertalk.com/forum/viewtopic.php?t=42901>; accessed Aug. 24, 2015.*

(Continued)

*Primary Examiner* — Jeremy Luks
(74) *Attorney, Agent, or Firm* — Hartman & Citrin LLC

(57) ABSTRACT

Embodiments of a firearm suppressor with a heat anodization treatment are disclosed herein. According to various embodiments, the firearm suppressor with a heat anodization treatment can include a firearm suppressor housing. The firearm suppressor housing can include an outer surface, an inner cavity, and an attachment mechanism that attaches the firearm suppressor housing to a barrel of a firearm. The firearm suppressor housing also can be treated with a heat anodization process to create a design that is a part of the firearm suppressor housing.

19 Claims, 5 Drawing Sheets

(56) References Cited

U.S. PATENT DOCUMENTS

| | | | |
|---|---|---|---|
| 5,092,223 | A | 3/1992 | Hudson |
| 5,136,923 | A | 8/1992 | Walsh, Jr. |
| 5,164,535 | A | 11/1992 | Leasure |
| 5,425,299 | A | 6/1995 | Teetzel |
| 5,476,028 | A | 12/1995 | Seberger, Jr. |
| 5,610,360 | A | 3/1997 | Kazyaka et al. |
| 5,773,746 | A | 6/1998 | Vaden |
| D415,812 | S | 10/1999 | Andrews, Jr. et al. |
| D415,813 | S | 10/1999 | O'Quinn et al. |
| D435,623 | S | 12/2000 | Andrews, Jr. et al. |
| 6,302,009 | B1 | 10/2001 | O'Quinn et al. |
| 6,308,609 | B1 | 10/2001 | Davies |
| 6,374,718 | B1 | 4/2002 | Rescigno et al. |
| 6,575,074 | B1 | 6/2003 | Gaddini |
| 7,073,426 | B1 | 7/2006 | White |
| 7,194,836 | B1 | 3/2007 | Urban |
| 7,325,474 | B2 | 2/2008 | Yoshimura et al. |
| D594,082 | S | 6/2009 | O'Quinn |
| 7,588,122 | B2 | 9/2009 | Brittingham |
| 7,854,085 | B1 | 12/2010 | Hodgkins et al. |
| 7,905,171 | B1 | 3/2011 | Brittingham |
| 8,087,338 | B1 | 1/2012 | Hines |
| 8,096,222 | B2 | 1/2012 | Silvers |
| 8,162,100 | B2 | 4/2012 | Shults et al. |
| 8,167,084 | B1 | 5/2012 | Moore |
| 8,439,155 | B2 | 5/2013 | Shults et al. |
| 8,453,789 | B1 * | 6/2013 | Honigmann et al. ..... 181/223 |
| 8,479,632 | B2 | 7/2013 | Kline et al. |
| 8,479,878 | B2 | 7/2013 | Schlosser |
| 8,561,757 | B1 | 10/2013 | Edsall |
| 8,978,818 | B2 | 3/2015 | Proske |
| 2007/0107590 | A1 | 5/2007 | Silvers |
| 2010/0126334 | A1 | 5/2010 | Shults et al. |
| 2011/0067950 | A1 | 3/2011 | Shults et al. |
| 2012/0255807 | A1 | 10/2012 | Pieratti |
| 2012/0297656 | A1 * | 11/2012 | Langevin et al. ..... 42/16 |

OTHER PUBLICATIONS

W. Moon; "Will Moon Custom Knives: Proper vs. Improperly done Heat Anodization"; Dec. 23, 2011; <http://willmooncustomknives.blogspot.com/2011/12/proper-vs-improperly-done-heat.html>; accessed Aug. 24, 2015.*

A. Daniel Klarmann, "MrTitanium Presents a short article on the physics of Anodized Titanium Color", Jan. 16, 2010 (original article from 2002), <http://web.archive.org/web/20100116094841/http://mrtitanium.com/interference.html>.*

U.S. Office Action dated Sep. 4, 2014 in U.S. Appl. No. 14/134,023.

U.S. Office Action dated Oct. 28, 2014 in U.S. Appl. No. 14/134,044.

U.S. Notice of Allowance dated Apr. 9, 2015 in U.S. Appl. No. 14/182,273.

* cited by examiner

FIREARM SUPPRESSOR WITH A HEAT ANODIZATION TREATMENT

CROSS-REFERENCE TO RELATED APPLICATIONS

This application claims priority to U.S. Provisional Patent Application No. 61/836,508, filed Jun. 18, 2013, entitled "Improved Suppressor," which is incorporated herein by reference in its entirety. This application also claims priority to U.S. Provisional Patent Application No. 61/872,012, filed Aug. 30, 2013, entitled "Light Enhanced Firearm Suppressor," which is incorporated herein by reference in its entirety. This application also claims priority to U.S. Provisional Patent Application No. 61/892,070, filed Oct. 17, 2013, entitled "Superior Signature Suppressor," which is incorporated herein by reference in its entirety. This application also claims priority to U.S. Provisional Patent Application No. 61/892,087, filed Oct. 17, 2013, entitled "Improved Surface Treatment Suppressor," which is incorporated herein by reference in its entirety. This application is related to U.S. patent application Ser. No. 14/134,023, filed Dec. 19, 2013, now U.S. Pat. No. 9,038,770, entitled "Firearm Suppressor," which is incorporated herein by reference in its entirety. This application also is related to U.S. patent application Ser. No. 14/134,044, filed Dec. 19, 2013, now U.S. Pat. No. 9,091,502, entitled "Light-Enhanced Firearm Suppressor," which is incorporated herein by reference in its entirety. This application also is related to U.S. patent application Ser. No. 14/182,273, filed Feb. 17, 2014, now U.S. Pat. No. 9,115,949, entitled "Coil-Equipped Firearm Suppressor," which is incorporated herein by reference in its entirety.

TECHNICAL FIELD

This disclosure relates generally to firearm technologies. More particularly, the disclosure made herein relates to a firearm suppressor with a heat anodization treatment that is durable, light weight, and economical.

BACKGROUND

Unless otherwise indicated herein, the materials described in this section are not prior art to the claims in this application and are not admitted to be prior art by inclusion in this section.

Firearm suppressors are sometimes referred to as "silencers." The term "silencer," however, while being partially accurate, does not explain or identify the various functions of a well-manufactured and well-used suppressor. In particular, a suppressor functions to not only suppress an audible signature of a firearm, but also to suppress the muzzle flash and other visible signatures of firearms. As such, suppressors can be used to allow firearm use without personal hearing protection by a shooter. In military applications, suppressors can reduce detectability, thereby allowing soldiers or other entities to discharge firearms without revealing their location. Soldiers also may use suppressors to discharge firearms without compromising their ability to hear other sounds in their environment.

Because suppressors can allow shooters to discharge firearms without personal hearing protection, and may reduce the muzzle flash and other visible effects of firearm discharge, suppressors have become popular accessories with shooters. In fact, some shooters wish to acquire a suppressor for each owned firearm after firing a suppressed firearm due to the reduced sound and flash of a firearm discharge. In general, suppressors can make shooting more enjoyable.

The benefits of suppressors, however, are not limited to comfort and enjoyment. Suppressors also can be used for personal defense, military applications, hunting, and the like. In particular, because adrenaline-inducing events can result in visual distortion such as tunnel vision, depth perception issues, and the like, which may pose personal safety risks, some firearm owners equip personal defense firearms with suppressors to reduce the likelihood of such issues in a violent encounter. For military applications, suppressors can aid soldiers in stealthily attacking targets with firearms by reducing the detectability of the firearms visually and audibly.

For these and other reasons, suppressors have become popular accessories for firearm owners and users. Suppressors, however, are expensive to make and therefore are expensive to own. Additionally, the regulatory framework around suppressor manufacturing and ownership combine with the high cost of manufacturing to result in limited suppressor ownership and availability. In general, suppressors function by dissipating high pressure gases between the muzzle and an ambient environment. As such, the greater the dissipation of these gases, the more effective the suppressor.

SUMMARY

Concepts and technologies are disclosed herein for a firearm suppressor with a heat anodization treatment. In some embodiments, a firearm suppressor or firearm suppressor housing is treated with a heat anodization process. The heat anodization process can be used to create a pattern or other design on the firearm suppressor or firearm suppressor housing. Unlike a surface treatment, the heat anodization process results in the design being formed in and actually becoming a part of the material used to form the firearm suppressor or firearm suppressor housing. Thus, the design can pass through the material and therefore can be a permanent part of the firearm suppressor or firearm suppressor housing.

In some embodiments, the heat anodization treatment results in a design that is wear-resistant and/or wear-proof. Furthermore, because the design is formed in the firearm suppressor or firearm suppressor housing, other surface finishes can be applied to the firearm suppressor or firearm suppressor housing to prevent glare, prevent corrosion, etc., without affecting the overall appearance and/or look and feel of the firearm suppressor or firearm suppressor housing. Thus, embodiments of the concepts and technologies described herein can be used to provide a durable appearance and/or design to a firearm suppressor or firearm suppressor housing. The heat anodization treatment also can be cheap, and the embodiments of the concepts and technologies described herein therefore also can be used to provide an economical appearance and/or design to a firearm suppressor or firearm suppressor housing.

According to various embodiments, a material and design for the firearm suppressor or firearm suppressor housing can be chosen. Based upon the material and design chosen, as well as other considerations such as ambient temperature, heating devices available, or the like; parameters of the heat anodization treatment can be determined. The heat anodization treatment can be applied to the firearm suppressor or firearm suppressor housing, and the surface can be finished (polished, brushed, sandblasted, coated, etc.) to change the aesthetic appearance and/or to increase, reduce, or otherwise change the reflectivity of the surface. The result can be a firearm suppressor or firearm suppressor housing with a design that is economical, durable, light (weightless), and customized to specific needs and/or desires.

According to one aspect of the concepts and technologies described herein, a firearm suppressor with a heat anodization treatment is disclosed. The firearm suppressor can include a firearm suppressor housing including an outer surface, an inner cavity that can accommodate one or more baffles or baffle assemblies, and an attachment mechanism that can attach the firearm suppressor housing to a barrel of a firearm. The firearm suppressor housing can be treated with a heat anodization process to create a design that is a part of the firearm suppressor housing.

In some embodiments, the firearm suppressor also can include a baffle located within the inner cavity of the firearm suppressor housing. In some embodiments, the firearm suppressor can include a baffle insert that includes two or more baffles. The baffle insert can be located within the inner cavity of the firearm suppressor housing. In some embodiments, the firearm suppressor housing can be formed from a metal. According to various embodiments, the metals can include, but are not limited to, titanium, steel, stainless steel, or other metals or alloys such as brass, copper, or the like.

In some embodiments, the design can include a pattern formed from a plurality of markings. The pattern can be selected from the group of patterns that includes a spiral pattern, a camouflage pattern, and a worm pattern. In some embodiments, the firearm suppressor housing has a finish applied on top of the design. The finish can include one or more finishes selected from a group of finishes that includes a polished finish, a satin finish, a brushed finish, a sandblasted finish, and a coating.

According to another aspect of the concepts and technologies described herein, a firearm suppressor with a heat anodization treatment is disclosed. The firearm suppressor can include a firearm suppressor housing formed from a metal. The firearm suppressor housing can include an outer surface, an inner cavity that is configured to receive a baffle insert, and an attachment mechanism that is configured to attach the firearm suppressor housing to a barrel of a firearm. The firearm suppressor housing can be treated with a heat anodization process to create a design. The design can be a part of the metal used to form the firearm suppressor housing.

In some embodiments, the firearm suppressor can include a baffle located within the inner cavity of the firearm suppressor housing. In some embodiments, the firearm suppressor can include a baffle insert that includes two or more baffles. The baffle insert can be located within the inner cavity of the firearm suppressor housing. In some embodiments, the design can include a pattern formed from a plurality of markings. In some embodiments, the firearm suppressor housing can have a finish applied on top of the design, and the design can be permanently resistant to wear and corrosion by being a part of the metal.

According to yet another aspect of the concepts and technologies described herein, a firearm suppressor with a heat anodization treatment is disclosed. The firearm suppressor can include a firearm suppressor housing formed from a metal. The firearm suppressor housing can include an outer surface, an inner cavity housing a baffle insert, and an attachment mechanism that can be configured to attach the firearm suppressor housing to a barrel of a firearm. The firearm suppressor housing can be treated with a heat anodization process to create a design. The design can be a part of the metal used to form the firearm suppressor housing.

In some embodiments, the baffle insert can include a plurality of baffles. In some embodiments, the design can include a pattern formed from two or more markings. In some embodiments, the firearm suppressor housing can include a surface finish that is applied on top of the design. The design can be permanently resistant to wear and corrosion by being a part of the metal. In some embodiments, the surface finish includes a finish that affects the reflectivity of the firearm suppressor.

The foregoing summary is illustrative only and is not in any way limiting. In addition to the illustrative aspects, embodiments, and features described above, further aspects, embodiments, and features will become apparent by reference to the drawings and the following detailed description.

DETAILED DESCRIPTION

Figure 1:
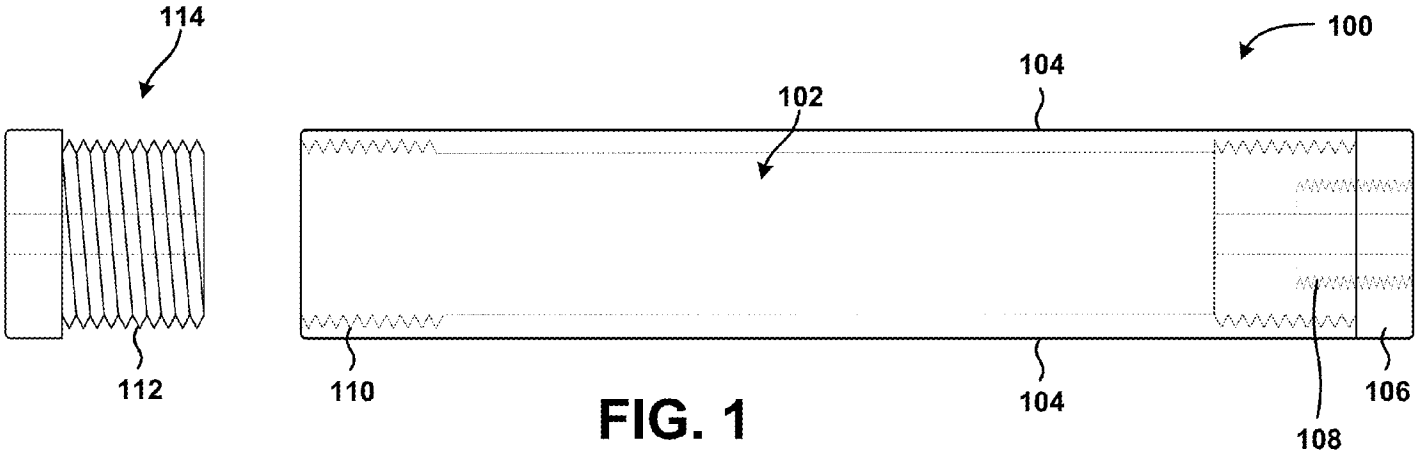
FIG. 1 is a line drawing illustrating an assembly view of a firearm suppressor housing, according to an illustrative embodiment of the concepts and technologies described herein.

The following detailed description is directed to a firearm suppressor with a heat anodization treatment. In some embodiments, a firearm suppressor or firearm suppressor housing is treated with a heat anodization process. The heat anodization process can be used to create a pattern or other design on the firearm suppressor or firearm suppressor housing. Unlike a surface treatment, the heat anodization process results in the design being formed in and actually becoming a part of the material used to form the firearm suppressor or firearm suppressor housing. Thus, the design can pass through the material and therefore can be a permanent part of the firearm suppressor or firearm suppressor housing.

In some embodiments, the heat anodization treatment results in a design that is wear-resistant and/or wear-proof. Furthermore, because the design is formed in the firearm suppressor or firearm suppressor housing, other surface finishes can be applied to the firearm suppressor or firearm suppressor housing to prevent glare, prevent corrosion, etc., without affecting the overall appearance and/or look and feel of the firearm suppressor or firearm suppressor housing. Thus, embodiments of the concepts and technologies described herein can be used to provide a durable appearance and/or design to a firearm suppressor or firearm suppressor housing. The heat anodization treatment also can be economical, and the embodiments of the concepts and technologies described herein therefore also can be used to provide an economical appearance and/or design to a firearm suppressor or firearm suppressor housing.

The heat anodization process can be completed with various types of heating including, but not limited to, flames, heated instruments, chemical reactions, electrical discharges, combinations thereof, or the like. In addition to varying the intensity and exposure time of the heating process, the materials used for the firearm suppressor housing can be varied. As such, various embodiments of the concepts and technologies described herein can provide a full spectrum of color options and/or ranges.

According to various embodiments, a material and design for the firearm suppressor or firearm suppressor housing can be chosen. Based upon the material and design chosen, as well as other considerations such as ambient temperature, heating devices available, heat intensity, heat exposure time, or the like; parameters of the heat anodization treatment can be determined. The heat anodization treatment can be applied to the firearm suppressor or firearm suppressor housing, and the surface can be finished (polished, brushed, sandblasted, coated, etc.) to change the aesthetic appearance and/or to increase, reduce, or otherwise change the reflectivity of the surface. The result can be a firearm suppressor or firearm suppressor housing with a design that is economical, durable, light (weightless), and customized to specific needs and/or desires. These and other aspects of the concepts and technologies described herein will be described herein in further detail.

In the following detailed description, references are made to the accompanying drawings that form a part hereof, and in which are shown by way of illustration specific embodiments or examples. It must be understood that the disclosed embodiments are merely illustrative of the concepts and technologies disclosed herein. The concepts and technologies disclosed herein may be embodied in various and alternative forms, and/or in various combinations of the embodiments disclosed herein. The word "illustrative," as used in the specification, is used expansively to refer to embodiments that serve as an illustration, specimen, model or pattern.

Additionally, it should be understood that the drawings are not necessarily to scale, and that some features may be exaggerated or minimized to show details of particular components. In other instances, well-known components, systems, materials or methods have not been described in detail in order to avoid obscuring the present disclosure. Therefore, specific structural and functional details disclosed herein are not to be interpreted as limiting, but merely as a basis for the claims and as a representative basis for teaching one skilled in the art to variously employ the present disclosure. Referring now to the drawings, in which like numerals represent like elements throughout the several figures, aspects of firearm suppressors with a heat anodization treatment will be presented.

Turning to FIG. 1, aspects of a firearm suppressor with a heat anodization treatment according to various embodiments of the concepts and technologies described herein will be described in detail. In particular, FIG. 1 illustrates one illustrative embodiment of a firearm suppressor housing 100. Because the concepts and technologies described herein for providing a firearm suppressor with a heat anodization treatment can be embodied in various implementations of firearm suppressors, it should be understood that the illustrated and described illustrative embodiment is merely one example of a suitable operating environment for the concepts and technologies described herein. As such, the illustrated and described embodiments should not be construed as being limiting in any way of the concepts and technologies described herein.

In some embodiments, as shown in FIG. 1, a firearm suppressor with a heat anodization treatment can include a firearm suppressor housing 100. The firearm suppressor housing 100 can be formed from an assembly of two or more components. In some embodiments, the firearm suppressor housing 100 may be formed from a substantially continuous piece of material such as a metal rod or metal tube that can be machined by various processes and/or tools. According to various embodiments, including the embodiment shown in FIG. 1, the firearm suppressor housing 100 can be formed as a cylindrical structure. The firearm suppressor housing 100 can include an inner cavity or void ("inner cavity") 102, which can be defined and/or bound by an outer surface 104.

Although not visible in FIG. 1, those of ordinary skill in the art of firearm suppressors will appreciate that the firearm suppressor housing 100 can receive and/or house a baffle, a baffle insert, a baffle assembly, and/or other structures and/or elements of a firearm suppressor, though this is not necessarily the case. Some example embodiments of baffle insert assemblies, baffles, baffle inserts, and/or other structures or elements that can be located within the inner cavity 102 are illustrated and described in U.S. Provisional Patent Application No. 61/836,508, filed Jun. 18, 2013, entitled "Improved Suppressor," which is incorporated herein by reference in its entirety; U.S. Provisional Patent Application No. 61/872,012, filed Aug. 30, 2013, entitled "Light Enhanced Firearm Suppressor," which is incorporated herein by reference in its entirety; U.S. Provisional Patent Application No. 61/892,070, filed Oct. 17, 2013, entitled "Superior Signature Suppressor," which is incorporated herein by reference in its entirety; U.S. patent application Ser. No. 14/134,023, filed Dec. 19, 2013, entitled "Firearm Suppressor," which is incorporated herein by reference in its entirety; U.S. patent application Ser. No. 14/134,044, filed Dec. 19, 2013, entitled Light-Enhanced Firearm Suppressor," which is incorporated herein by reference in its entirety; and U.S. patent application Ser. No. 14/182,273, filed Feb. 17, 2014, entitled "Coil-Equipped Firearm Suppressor," which is incorporated herein by reference in its entirety. Because other baffles, baffle inserts, baffle insert assemblies, and/or other structures and/or elements are possible and are contemplated, it should be understood that these examples are illustrative and therefore should not be construed as being limiting in any way.

The firearm suppressor housing 100 also can include and/or can engage a leading edge cap 106. The leading edge cap 106 can include and/or can be configured to engage barrel threads 108 or other structures. According to various embodiments of the concepts and technologies described herein, the barrel threads 108 are configured to engage threads or other structures of a barrel of a firearm (not shown in FIG. 1). Thus, the barrel threads 108 can be used to hold a firearm suppressor with a heat anodization treatment in an operating configuration with respect to a firearm, as generally is understood by one familiar with the operation of firearm suppressors. Because the leading edge cap 106 and the barrel threads 108 are generally understood structural elements of firearm suppressors, these elements are not further described herein. Also, because the barrel threads 108 can be replaced and/or supplemented with alternative connection mechanisms, it should be understood that the threads are merely illustrative of one contemplated embodiment and therefore should not be construed as being limiting in any way.

The firearm suppressor housing 100 and/or the components of the firearm suppressor housing 100 may be formed by various processes and/or materials. According to various embodiments of the concepts and technologies described herein, the firearm suppressor housing 100, or a portion thereof, can be formed from metals and/or metal alloys such as steel, aluminum, titanium, brass, copper, magnesium alloys, aluminum alloys, other metals or alloys, combinations thereof, or the like. In some embodiments, one or more components of the firearm suppressor housing 100 can be formed from non-metal and/or non-metal-alloy materials such as resins, polymers, and/or other materials. In some embodiments, for example, the firearm suppressor housing 100, or a portion thereof, can be formed from resins such as epoxy resins, or the like. In some embodiments, for example, the firearm suppressor housing 100, or a portion thereof, can be formed from one or more polymers such as various thermoplastics, polypropylene, polycarbonates, aerogel, graphite filled NYLON, phenolics, polyimides, and/or other polymers, combinations thereof, or the like. Because the firearm suppressor housing 100 can be formed from additional and/or alternative materials, it should be understood that these examples are illustrative and therefore should not be construed as being limiting in any way.

The firearm suppressor housing 100 can be formed using various processes such as, for example, extrusion, machining, injection molding, casting, combinations thereof, or the like. In one contemplated embodiment, the firearm suppressor housing 100 is formed from an extruded or formed metal tube (e.g., an extruded aluminum tube) that can be machined to obtain the various structures visible in FIG. 1 as well as additional or alternative structures. In another contemplated embodiment, the firearm suppressor housing 100, or a portion thereof, can be formed from a metal rod (e.g., an extruded or formed aluminum or steel rod or pipe) that can be machined using various tools and/or processes to obtain the firearm suppressor housing 100. Because various manufacturing processes can be used and/or selected based upon various needs (cost, materials, time, etc.), it should be understood that these examples are illustrative and therefore should not be construed as being limiting in any way.

As noted above, the outer surface 104 of the firearm suppressor housing 100 and/or the entire firearm suppressor housing 100 can be treated for various purposes. According to various embodiments of the concepts and technologies described herein, the outer surface 104 of the firearm suppressor housing 100, or the entire firearm suppressor housing 100, also can be polished, sandblasted, or otherwise treated to provide a shiny, satin, or unfinished surface appearance. Furthermore, various embodiments of the concepts and technologies described herein include heat treating the outer surface 104 of the firearm suppressor housing 100, or the entire firearm suppressor housing 100, to create a heat anodization treatment, if desired. A heat anodization treatment is not visible in FIG. 1, but will be illustrated and described in additional detail below, particularly with reference to FIGS. 3-8. For example, the firearm suppressor housing 100 can be formed from steel, stainless steel, and/or titanium, and can be treated with a heat anodization process such as the heat anodization process described herein and/or as illustrated and described in U.S. Provisional Patent Application No. 61/892,087, filed Oct. 17, 2013, entitled "Improved Surface Treatment Suppressor," which is incorporated herein by reference in its entirety. Because additional and/or alternative treatment processes are possible and are contemplated, it should be understood that these examples are illustrative and therefore should not be construed as being limiting in any way.

Some embodiments of the firearm suppressor with a heat anodization treatment can include one or more components treated with a heat anodization process mentioned above. In particular, one contemplated embodiment includes a firearm suppressor housing 100 that is made from titanium that is treated with a heat anodized process to provide a durable aesthetic appearance. The heat anodization also can be used to alter the makeup of the steel, stainless steel, titanium, or other metal and/or metal alloy to change the performance characteristics of a firearm suppressor. It should be understood that these examples are illustrative and therefore should not be construed as being limiting in any way.

The firearm suppressor housing 100 also can include trailing edge cap attachment threads 110. The trailing edge cap attachment threads 110 can be configured to engage reciprocal housing attachment threads 112 of a trailing edge cap 114 or other attachment such as a lighting attachment, or the like. The trailing edge cap attachment threads 110 can be replaced and/or supplemented with other attachment mechanisms, if desired, such as rivets, bolts, compression fittings, pins, combinations thereof, or the like Because the trailing edge cap attachment threads 110 can be replaced and/or supplemented with additional and/or alternative attachment mechanisms, it should be understood that the housing attachment threads 112 of the trailing edge cap 114 can be replaced and/or supplemented with additional and/or alternative connection mechanisms and/or reciprocal connection mechanisms.

Figure 2:
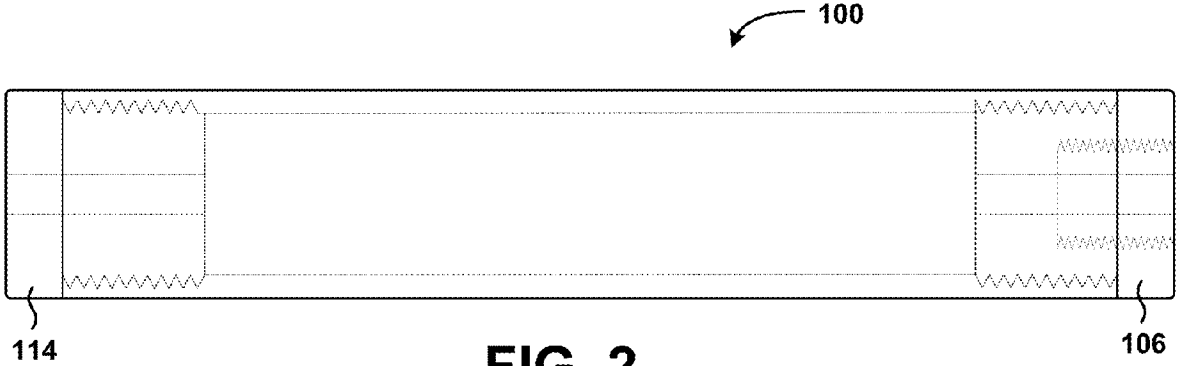
FIG. 2 is a line drawing illustrating the firearm suppressor housing shown in FIG. 1, according to another illustrative embodiment of the concepts and technologies described herein.

According to various embodiments, as shown with collective reference to FIGS. 1 and 2, the trailing edge cap 114 can be connected to the firearm suppressor housing 100 by mating connection mechanisms on the firearm suppressor housing 100 and the trailing edge cap 114, for example the trailing edge cap attachment threads 112 and the housing attachment threads 110, respectively. Although not visible in FIGS. 1-2, it should be understood that other structures can be located between the firearm suppressor housing 100 and the trailing edge cap 114, for example a plastic or silicone washer, padding, combinations thereof, or the like. Furthermore, one or more baffles, baffle inserts, coils, rods, and/or other structures and/or components can be located within the firearm suppressor housing 100 to obtain and/or form a firearm suppressor with a heat anodization treatment. These and other aspects of the concepts and technologies described herein will be further illustrated and described below.

Figure 3:
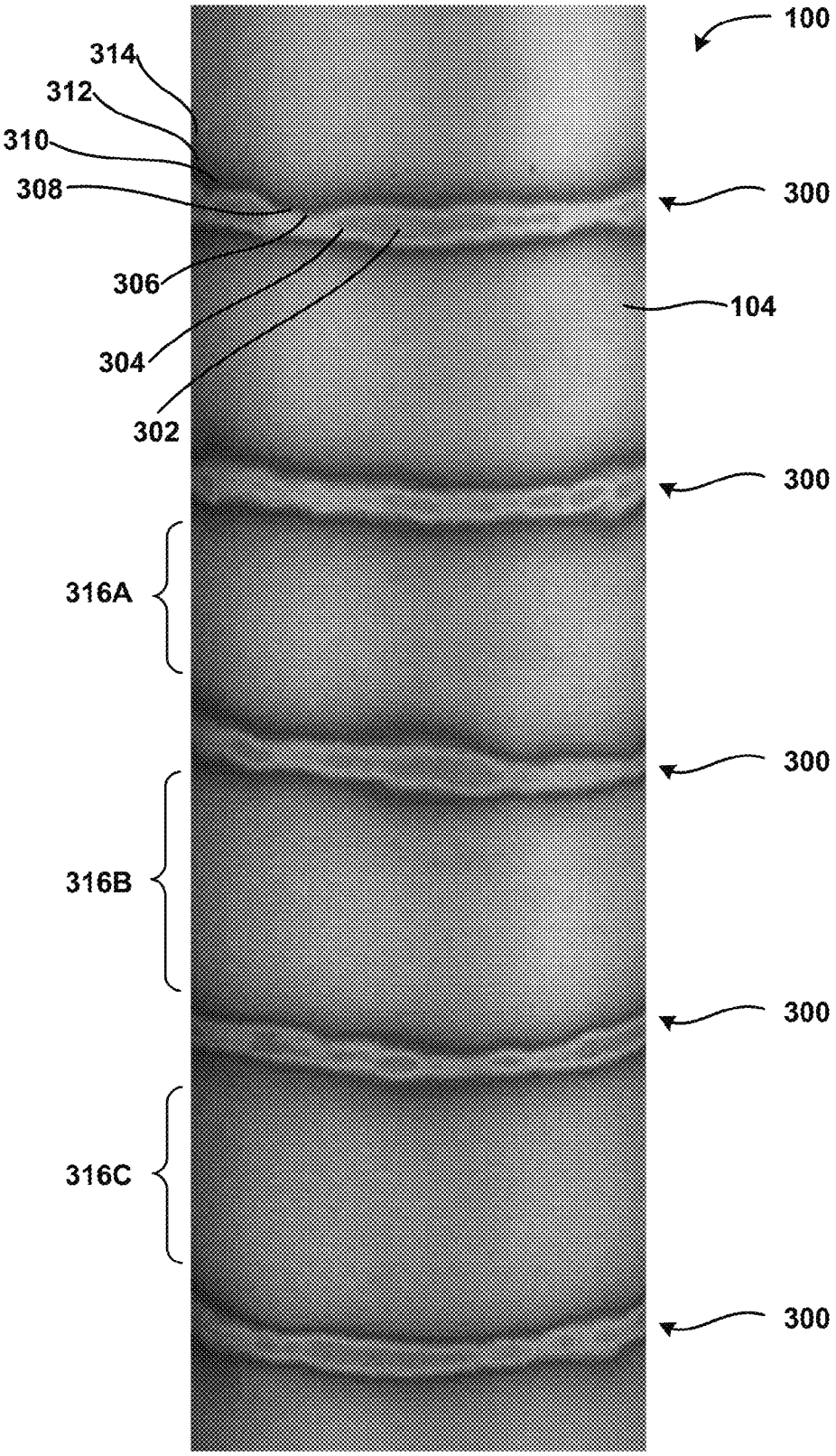
FIG. 3 is a photograph showing example markings formed on a firearm suppressor housing or firearm suppressor using a heat anodization treatment, according to one illustrative embodiment of the concepts and technologies described herein.

Turning now to FIG. 3, additional aspects of the concepts and technologies described herein for providing a firearm suppressor with a heat anodization treatment will be described in detail. In particular, FIG. 3 is a photograph showing a portion of a firearm suppressor housing 100. In FIG. 3, it can be appreciated that a heat anodization treatment has been applied to the firearm suppressor housing 100. In particular, the outer surface 104 of the firearm suppressor housing 100 includes a number of markings 300. The markings 300 shown in FIG. 3 have been formed by applying heat to the outer surface 104 of the firearm suppressor housing 100.

It should be understood that the term "marking," as used herein to refer to the markings 300 refers not only to a design or marking that is visible on the outer surface 104 of the firearm suppressor housing 100. Rather, the markings 300 illustrated and described herein alter the structure and color of the firearm suppressor housing 100 and therefore pass through the material from the outer surface 104 to an inner surface that borders the inner cavity 102. Thus, the markings 300 illustrated and described herein are not merely printed onto the outer surface 104, and actually alter the physical makeup of the firearm suppressor housing 100.

In particular, the heat applied to the firearm suppressor housing 100 to form the markings 300 can alter the color of the firearm suppressor housing 100. Additionally, the heat applied to the firearm suppressor housing 100 to form the markings 300 can alter the hardness of the firearm suppressor housing 100. Additionally, the heat applied to the firearm suppressor housing 100 to form the markings 300 can alter the tensile strength of the firearm suppressor housing 100. Still further, the heat applied to the firearm suppressor housing 100 to form the markings 300 can alter the physical arrangement of molecules and/or atoms of the firearm suppressor housing 100. Thus, it should be appreciated that the heat applied to the firearm suppressor housing 100 to form the markings 300 can transform the material used to form the firearm suppressor housing 100. Because the heat can cause additional or alternative changes to the firearm suppressor housing 100, it should be understood that these examples are illustrative and therefore should not be construed as being limiting in any way.

As can be seen in FIG. 3, the markings 300 can be provided by heat-induced color changes to the material (e.g., steel, stainless steel, titanium, etc.). The markings 300 can include smooth color changes (e.g., a gradual change from color to color) from a first color associated with the unfinished firearm suppressor housing 100 to one or more other colors. Thus, while the markings 300 are described below with reference to seven color regions, it should be understood that these color regions are merely illustrative of changes in color that are easily detectable by the human eye. In reality, the markings 300 can include hundreds, thousands, or even more color variations. Thus, it should be understood that this example is illustrative and therefore should not be construed as being limiting in any way.

As shown in FIG. 3, the marking 300 can include a first region 302 at an innermost point of the marking 300. This first region 302 can correspond, in some embodiments, to a center line of a flame emitted by a torch or other heating tool and/or a point at which the flame was closest to the outer surface of the firearm suppressor housing 100. Because a flame includes hot and cool portions, it can be seen in FIG. 3 that the first region 302 is not of consistent width and/or shape with respect to the total width of the marking 300. As will be explained in more detail below, forms of heat other than flames are used in some embodiments, so this example should not be construed as being limiting in any way. In the illustrated embodiment, wherein the firearm suppressor housing 100 is formed from titanium, the first region 302 can have a green to indigo and/or violet appearance. It should be understood that this example is illustrative and therefore should not be construed as being limiting in any way.

The marking 300 also can include a second region 304. The second region 304 can correspond to a visible boundary of the first region 302 and/or an area at which the first region 302 visibly ends. Thus, the second region 304 can include an area of the marking 300 that may be lighter or darker than the first region 302. In the illustrated embodiment, wherein the firearm suppressor housing 100 is formed from titanium, the second region 304 is lighter than the first region 302 and can have a red to violet appearance. Because other materials can be used, it should be understood that this example is illustrative and therefore should not be construed as being limiting in any way.

The marking 300 also can include a third region 306. The third region 306 can correspond to a visible boundary of the second region 304 and/or an area at which the second region 304 visibly ends. Thus, the third region 306 can include an area of the marking 300 that may be lighter or darker than the second region 304. In the illustrated embodiment, wherein the firearm suppressor housing 100 is formed from titanium, the third region 306 is darker than the second region 304 and can have an indigo appearance. Because other materials can be used, it should be understood that this example is illustrative and therefore should not be construed as being limiting in any way.

The marking 300 also can include a fourth region 308. The fourth region 308 can correspond to a visible boundary of the third region 306 and/or an area at which the third region 306 visibly tapers or ends. Thus, the fourth region 308 can include an area of the marking 300 that may be lighter or darker than the third region 306. In the illustrated embodiment, wherein the firearm suppressor housing 100 is formed from titanium, the fourth region 308 is darker than the third region 306 and can have a dark indigo to blue appearance. Because other materials can be used, it should be understood that this example is illustrative and therefore should not be construed as being limiting in any way.

The marking 300 also can include a fifth region 310. The fifth region 310 can correspond to a visible boundary of the fourth region 308 and/or an area at which the fourth region 308 visibly tapers or ends. Thus, the fifth region 310 can include an area of the marking 300 that may be lighter or darker than the fourth region 308. In the illustrated embodiment, wherein the firearm suppressor housing 100 is formed from titanium, the fifth region 310 can have a dark blue to red appearance. Because other materials can be used, it should be understood that this example is illustrative and therefore should not be construed as being limiting in any way.

The marking 300 also can include a sixth region 312. The sixth region 312 can correspond to a visible boundary of the fifth region 310 and/or an area at which the fifth region 310 visibly tapers or ends. Thus, the sixth region 312 can include an area of the marking 300 that may be lighter or darker than the fifth region 310. In the illustrated embodiment, wherein the firearm suppressor housing 100 is formed from titanium, the sixth region 312 can be lighter than the fifth region 310 and can have a light red to orange appearance. Because other materials can be used, it should be understood that this example is illustrative and therefore should not be construed as being limiting in any way.

The marking 300 can end at a seventh region 314. The seventh region 314 can correspond to a visible boundary of the marking 300 and/or an area at which the marking 300 begins and/or ends. Thus, the seventh region 314 can be lighter or darker than the sixth region 312 of the marking. In the illustrated embodiment, wherein the firearm suppressor housing 100 is formed from titanium, the seventh region 314 corresponds to an unfinished color of the firearm suppressor housing 100 and therefore is lighter than the sixth region 312. Because other materials can be used, it should be understood that this example is illustrative and therefore should not be construed as being limiting in any way.

Although not visible in FIG. 3, the markings 300 can pass through the material used to form the firearm suppressor housing 100, as noted above. As such, the markings 300 can be visible on an inside surface of the firearm suppressor housing 100. Of course, depending upon the thickness and/or other material characteristics of the firearm suppressor housing 100, the markings 300 may have a different appearance on the inside surface of the firearm suppressor housing 100 relative to the outer surface 104 of the firearm suppressor housing 100. It should be understood that this example is illustrative and therefore should not be construed as being limiting in any way.

Also, as shown in FIG. 3, the markings 300 can be formed with gaps 316A-C (hereinafter collectively and/or generically referred to as "gaps 316") in between the markings 300. As can be seen in FIG. 3, the gap 316A can be smaller than the gap 316C, and the gap 316C can be smaller than the gap 316B. It should be understood that this example is illustrative and therefore should not be construed as being limiting in any way.

Figure 4:
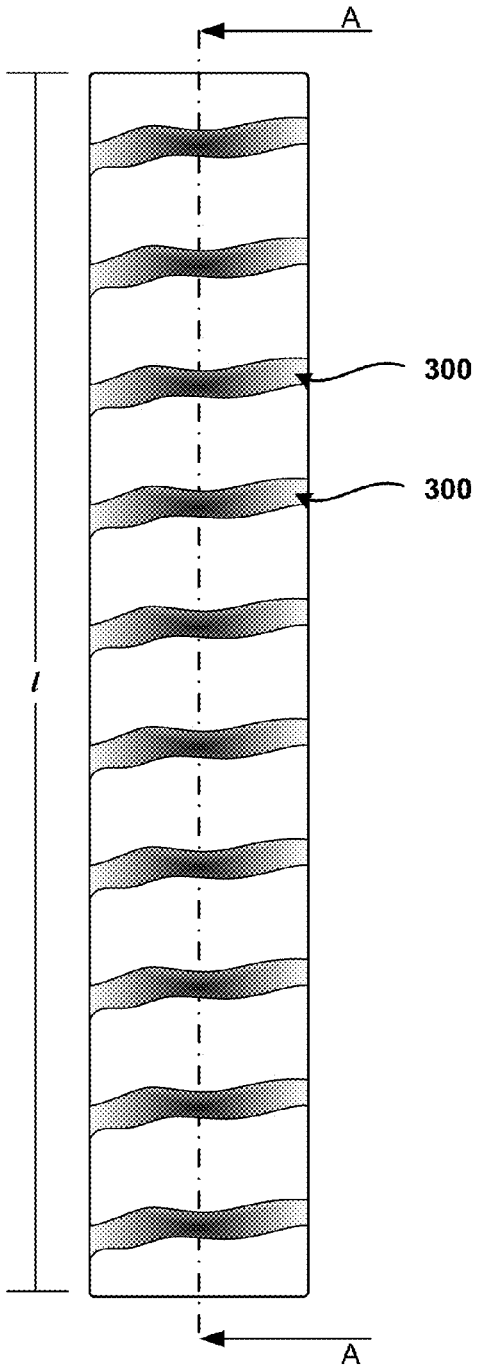
FIG. 4 is a line drawing illustrating an example pattern formed on a firearm suppressor housing or firearm suppressor using a heat anodization treatment, according to one illustrative embodiment of the concepts and technologies described herein.

Turning now to FIG. 4, additional aspects of the concepts and technologies described herein for providing a firearm suppressor with a heat anodization treatment will be described in detail. In particular, FIG. 4 is a line drawing showing an example pattern for a firearm suppressor housing 100, according to an example embodiment of the concepts and technologies described herein. In FIG. 4, it can be appreciated that a heat anodization treatment has been applied to the firearm suppressor housing 100. In particular, the outer surface 104 of the firearm suppressor housing 100 includes a number of markings 300. The markings 300 shown in FIG. 4 have been formed by applying heat to the outer surface 104 of the firearm suppressor housing 100.

In FIG. 4, the markings 300 are arranged in a spiral pattern. The spiral pattern represented in FIG. 4 can correspond to a pattern that may be formed by rotating the firearm suppressor housing 100 (e.g., on a lathe), bringing a flame from a torch into contact with the firearm suppressor housing 100, and then moving the torch along the length 1 of the firearm suppressor housing 100. Because the spiral pattern can be formed in other manners (e.g., by moving the torch around the firearm suppressor housing 100, by using other heating tools or emitters, or the like), it should be understood that this example is illustrative and therefore should not be construed as being limiting in any way.

Figure 5:
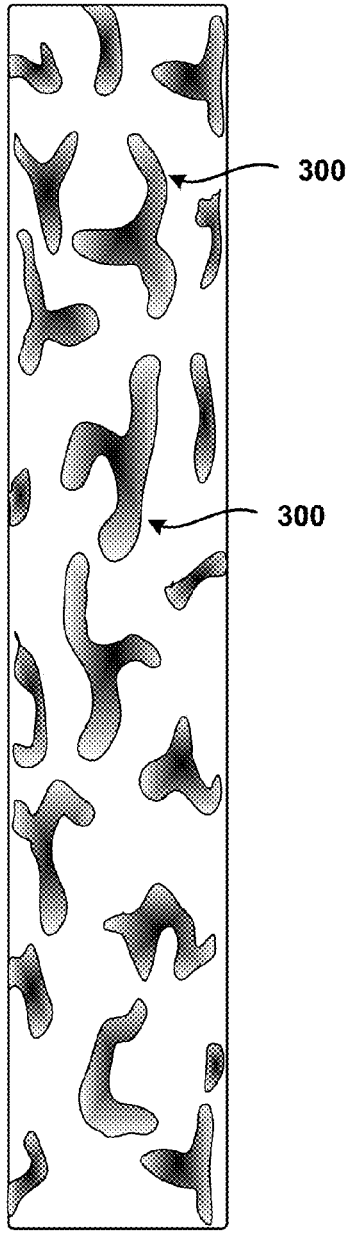
FIG. 5 is a line drawing illustrating an example pattern formed on a firearm suppressor housing or firearm suppressor using a heat anodization treatment, according to another illustrative embodiment of the concepts and technologies described herein.

Turning now to FIG. 5, additional aspects of the concepts and technologies described herein for providing a firearm suppressor with a heat anodization treatment will be described in detail. In particular, FIG. 5 is a line drawing showing an example pattern for a firearm suppressor housing 100, according to another example embodiment of the concepts and technologies described herein. In FIG. 5, it can be appreciated that a heat anodization treatment has been applied to the firearm suppressor housing 100. In particular, the outer surface 104 of the firearm suppressor housing 100 includes a number of markings 300. The markings 300 shown in FIG. 5 have been formed by applying heat to the outer surface 104 of the firearm suppressor housing 100.

In FIG. 5, the markings 300 are arranged in a camouflage pattern. The camouflage pattern represented in FIG. 5 can correspond to a pattern than may be formed by bring a flame from a torch into contact with the firearm suppressor housing 100 and then moving the torch or the firearm suppressor housing 100 to form the markings 300. After each marking 300 is formed, the torch can be turned off or the flame of the torch can be brought out of contact with the firearm suppressor housing 100, and a next marking can be formed in a similar manner as described above. Because the camouflage pattern can be formed in other manners (e.g., by multiple torches and/or other heated instruments, or the like), it should be understood that this example is illustrative and therefore should not be construed as being limiting in any way.

Figure 6:
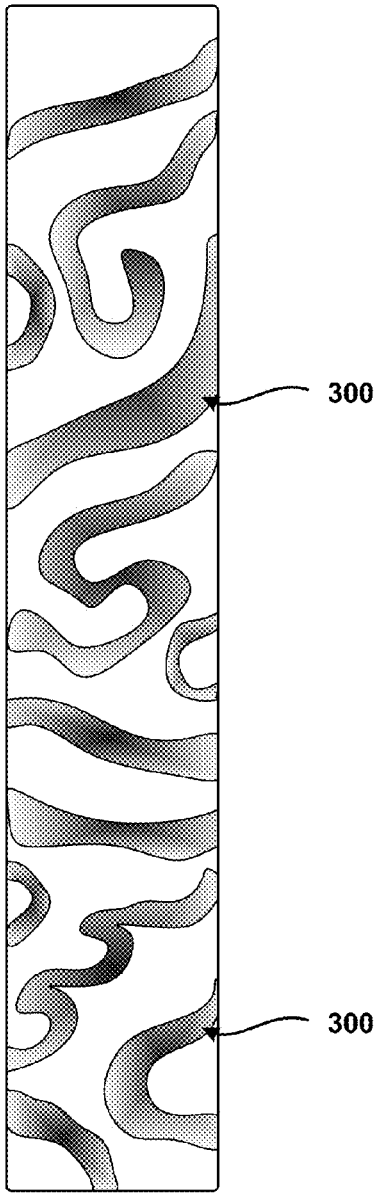
FIG. 6 is a line drawing illustrating an example pattern formed on a firearm suppressor housing or firearm suppressor using a heat anodization treatment, according to yet another illustrative embodiment of the concepts and technologies described herein.

Turning now to FIG. 6, additional aspects of the concepts and technologies described herein for providing a firearm suppressor with a heat anodization treatment will be described in detail. In particular, FIG. 6 is a line drawing showing an example pattern for a firearm suppressor housing 100, according to yet another example embodiment of the concepts and technologies described herein. In FIG. 6, it can be appreciated that a heat anodization treatment has been applied to the firearm suppressor housing 100. In particular, the outer surface 104 of the firearm suppressor housing 100 includes a number of markings 300. The markings 300 shown in FIG. 6 have been formed by applying heat to the outer surface 104 of the firearm suppressor housing 100.

In FIG. 6, the markings 300 are arranged in a worm pattern. The worm pattern represented in FIG. 6 can correspond to a pattern than may be formed by bringing a flame from a torch into contact with the firearm suppressor housing 100 and then moving the torch with respect to the firearm suppressor housing 100 to create a desired pattern. As can be appreciated from FIG. 6, the worm pattern may be irregular and/or may not have a defined shape. It should be understood that the markings can have shapes (e.g., letters, designs, logos, or the like), and therefore the illustrated embodiment is only one example embodiment. Because the worm pattern can be formed in other manners (e.g., by moving the torch around the firearm suppressor housing 100, by using other heating tools or emitters, or the like), it should be understood that this example is illustrative and therefore should not be construed as being limiting in any way.

Figure 7:
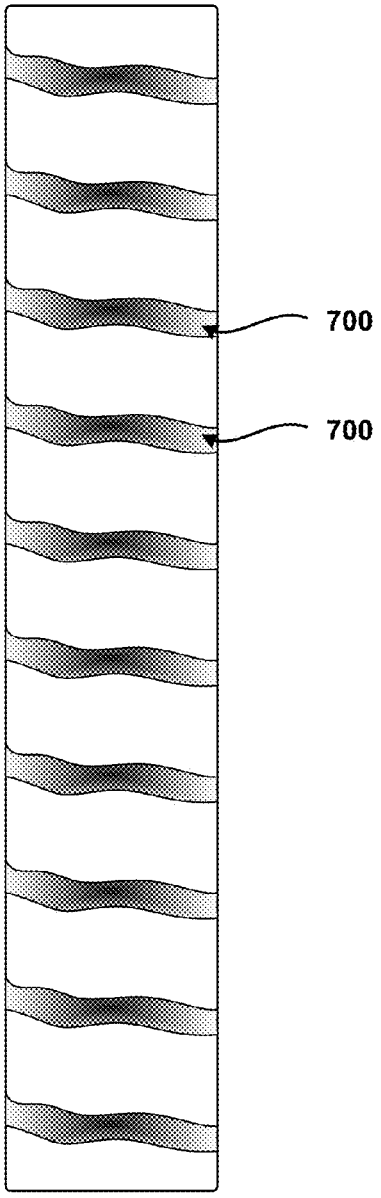
FIG. 7 is a line drawing illustrating a cutaway view of an example pattern formed on a firearm suppressor housing or firearm suppressor using a heat anodization treatment, according to one illustrative embodiment of the concepts and technologies described herein.

Turning now to FIG. 7, additional aspects of the concepts and technologies described herein for providing a firearm suppressor with a heat anodization treatment will be described in detail. In particular, FIG. 7 is a line drawing illustrating a cut-away view of the firearm suppressor housing 100 shown in FIG. 4, according to an example embodiment of the concepts and technologies described herein. In particular, the view illustrated In FIG. 7 can correspond to a view of the firearm suppressor housing 100 shown in FIG. 4 that would be visible if the firearm suppressor housing 100 was cut along the line A-A.

As discussed above, and shown in FIG. 7, the markings 300 can pass through the material used to form the firearm suppressor housing 100. Thus, in FIG. 7, inner markings 700 are visible. The inner markings 700 can correspond or be similar to, in some embodiments, mirror images of the markings 300 visible on the outer surface 104. Thus, with reference to FIG. 7 it can be appreciated that the markings 300 are not merely surface treatments, but rather alter the makeup of the material used to form the firearm suppressor housing 100.

Because the markings 300 are actually part of the material used to form the firearm suppressor housing 100, the markings can be as durable as the firearm suppressor housing 100 itself. In other words, while some surface treatments applied to firearm suppressors and/or housings (such as the firearm suppressor housing 100 illustrated and described herein) may scratch off and/or deteriorate over time, the markings 300 illustrated and described herein can last as long as the firearm suppressor housing 100 lasts. Thus, the concepts and technologies described herein can be used to provide a durable and economical treatment that gives the firearm suppressor housing 100 a desired appearance.

As such, the concepts and technologies described herein can be used to prevent degradation of the appearance of the firearm suppressor housing 100 (and/or a firearm suppressor formed from the firearm suppressor housing 100) due to use, time, wear, and/or corrosion. Because the treatment passes through the material, the design can be impervious to scratching off and/or burning off. Furthermore, in the event that the firearm suppressor housing 100 is heated up (e.g., through use with automatic weapons, or the like), the color of the material will change in a substantially uniform manner, thereby maintaining a look and feel of the original design, notwithstanding slight color changes.

According to various embodiments of the concepts and technologies described herein, the heat anodizing process illustrated and described herein can cause markings 300 and/or other aesthetic features of a firearm suppressor to become part of the firearm suppressor. As such, the markings 300 and/or other aesthetic features can be protected from being worn, scratched, or sanded off and/or burned off like conventional treatments and/or paints for firearm suppressors. Furthermore, heat anodizing offers a cost effective way to incorporate patterns that mimic natural environments. Thus, the designs can have a benefit in military situations by providing a camouflage design. Furthermore, the designs can have aesthetic and/or cosmetic appeal and therefore can provide a benefit by way of improving the appearance of firearm suppressors.

Still further, heat anodizing can offer a cost effective way to incorporate artistic expression that can become a permanent feature of the firearm suppressor by being an actual part of the material used to form the firearm suppressor rather than being painted on like traditional surface treatments for firearm suppressors. Additionally, heat anodizing can offer a unique visual appearance that can be used to bolster source association with a particular firearm suppressor and therefore may become synonymous with a particular provider, in addition to improving the aesthetic and/or cosmetic appearance of the firearm suppressor. Additionally, heat anodizing can offer a completely weightless finish, and therefore can provide a lightweight (weightless) improvement to the visual appearance of a firearm suppressor and/or firearm suppressor housing. The treatment also can be applied to existing firearm suppressors and/or components economically. Because additional and/or alternative benefits can be realized by various embodiments of the concepts and technologies described herein, it should be understood that these examples of benefits are illustrative and therefore should not be construed as being limiting in any way.

Some embodiments of the concepts and technologies described herein also can be used to improve the performance of a firearm suppressor formed from the firearm suppressor housing 100 and treated with the heat anodization process illustrated and described herein. In particular, the heat anodization process can alter the hardness and tensile strength of the material used to form the firearm suppressor and/or firearm suppressor housing 100. Thus, the frequency of sound emitted from a firearm suppressor treated with the heat anodization process described herein can be different than the frequency of sound emitted from an untreated firearm suppressor. Similarly, some of the patterns can further affect the sound emitted from the firearm suppressor. Some embodiments of the concepts and technologies described herein include using the heat anodization to create a pattern that further suppresses sound within the firearm suppressor. It should be understood that these examples are illustrative and therefore should not be construed as being limiting in any way.

Figure 8:
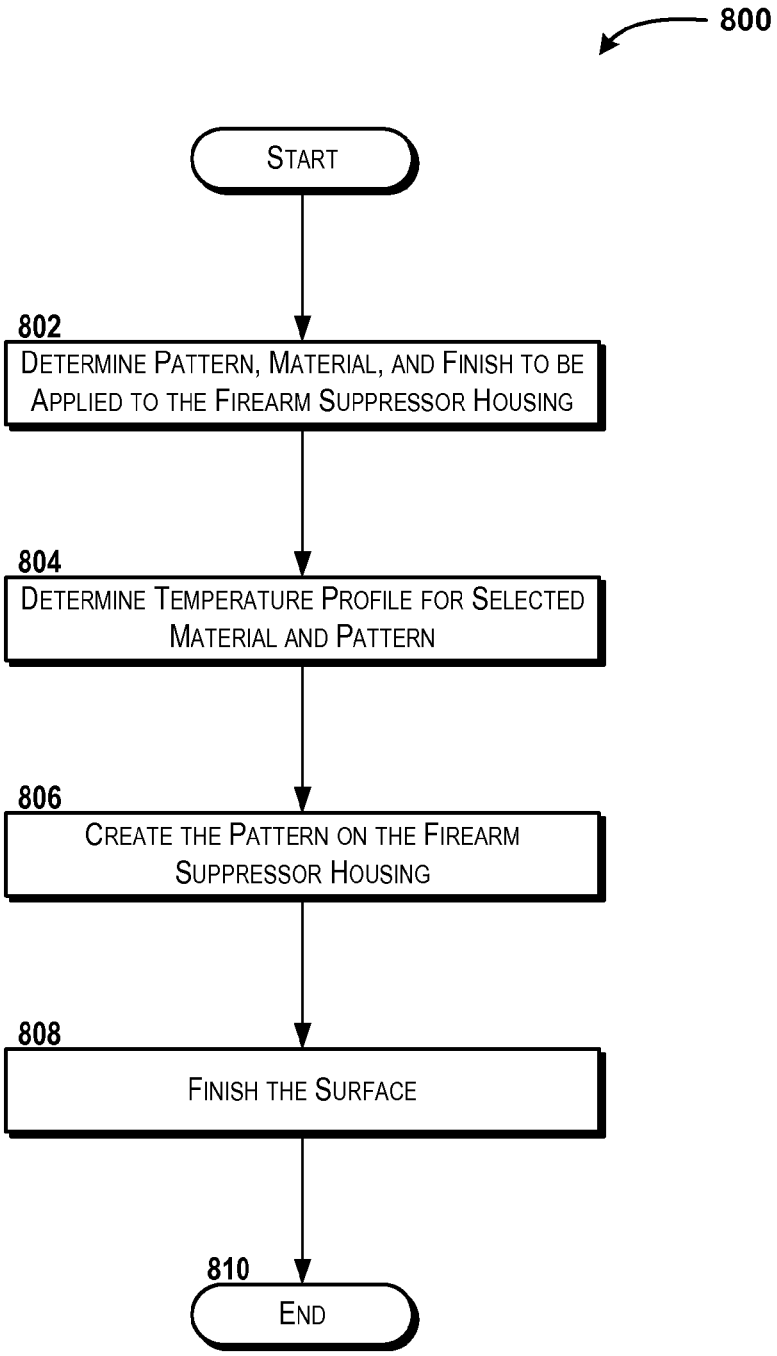
FIG. 8 is a flow diagram schematically illustrating a method for applying a heat anodization treatment to a firearm suppressor, according to one embodiment of the concepts and technologies described herein.

Turning now to FIG. 8, aspects of a method 800 for applying a heat anodization treatment to a firearm suppressor will be described in detail, according to an illustrative embodiment. It should be understood that the operations of the method 800 disclosed herein are not necessarily presented in any particular order and that performance of some or all of the operations in an alternative order(s) is possible and is contemplated. The operations have been presented in the demonstrated order for ease of description and illustration. Operations may be added, omitted, and/or performed simultaneously, without departing from the scope of the appended claims. It also should be understood that the illustrated method 800 can be ended at any time and need not be performed in its entirety.

For purposes of illustrating and describing the concepts of the present disclosure, the method 800 is described as being performed by machine such as a CNC machine or other devices (e.g., an assembly line) via execution of one or more software modules such as, for example, a heat anodization application that can execute on a control system or other computing device such as a laptop computer, tablet computer, smartphone, desktop computer, server computer, or the like. It should be understood that additional and/or alternative devices can provide the functionality described herein via execution of one or more modules, applications, and/or other software including, but not limited to, the heat anodization application. Thus, the illustrated embodiments are illustrative, and should not be viewed as being limiting in any way.

The method 800 begins at operation 802. In operation 802, the computer system can determine a pattern, material, and finish to be applied to the firearm suppressor housing and/or a firearm suppressor. Operation 802 can correspond, in some embodiments, to a user or other entity selecting (e.g., via a user interface or the like) a desired pattern such as the spiral pattern, camouflage pattern, or worm pattern illustrated and described hereinabove, or selecting other patterns such as random patterns, designs, writing, logos, or the like. Operation 802 also can correspond to a user or other entity selecting a desired material.

The available materials can be provided in a user interface, list, or otherwise, and the user or other entity can select the desired material. The material can be selected based upon availability, cost, or other considerations. Operation 802 also can correspond to a user or other entity selecting a desired finish. The available finishes can be provided in a user interface, list, or otherwise, and the user or other entity can select the desired finish (e.g., polished, satin, sandblasted, or the like). The finish can be selected based upon intended use and/or other considerations. For example, a polished or satin finish may be undesirable in military applications as the firearm suppressor may reflect light, and as such a sandblasted surface may be preferred. It should be understood that this example is illustrative and therefore should not be construed as being limiting in any way.

From operation 802, the method 800 proceeds to operation 804. In operation 804, the computer system can determine a temperature profile for the selected material and pattern. Because the material can react to heat based upon its material characteristics (type of metals, structure, thickness, tensile strength, hardness, ambient temperature, density, combinations thereof, or the like), the computer system can set the heat and/or variations in the heat to be applied to the firearm suppressor housing 100 based upon the selected material and/or pattern. Similarly, because some patterns may have multiple markings 300 near one another, the computer system may be configured to use a lower heat and/or a thin flame tip to form the markings 300 to prevent overlap and/or intersection of the markings 300. Because the temperature profile can be determined in additional and/or alternative ways, it should be understood that this example is illustrative and therefore should not be construed as being limiting in any way.

From operation 804, the method 800 proceeds to operation 806. In operation 806, the computer system can execute operations to create (or instruct other devices to create) the pattern on the firearm suppressor housing 100 or firearm suppressor. As briefly described above, a heating device such as a torch, soldering gun, electric discharge device, or other device can be moved relative to the firearm suppressor housing 100 or firearm suppressor. Alternatively, the firearm suppressor housing 100 or firearm suppressor can be moved relative to the heating device such as a torch, soldering gun, electric discharge device, or other device. Alternatively, both of the heating device and the firearm suppressor housing 100 or firearm suppressor can be moved relative to one another. Because the patterns can be created in other ways, it should be understood that these examples are illustrative and therefore should not be construed as being limiting in any way.

From operation 806, the method 800 proceeds to operation 808. In operation 808, the computer system can execute operations to finish (or instruct other devices to finish) the surface of the firearm suppressor housing 100 or firearm suppressor. Thus, the computer system can cause a device or assembly line of two or more devices to provide a polished, satin, sandblasted, or other surface to the firearm suppressor housing 100 or firearm suppressor. It should be understood that this example is illustrative and therefore should not be construed as being limiting in any way.

From operation 808, the method 800 proceeds to operation 810. The method 800 can end at operation 810.

In the description above, various embodiments of the heat anodization process have been described with reference to flames, torches, and/or heated instruments of various types. It should be understood that the heat anodization process can be performed using various types of heating, electrical discharge, and/or chemical reactions in addition to, or instead of, open flames and/or heated instruments. In particular, some embodiments of the concepts and technologies described herein for a heat anodization process make use of chemically induced reactions, plasma and/or plasma welding processes, electrical discharge processes, combinations thereof, or the like. As such, the example of using a flame or torch should be understood as being merely illustrative of one embodiment of creating heat and therefore should not be construed as being limiting in any way.

The above description also has referenced various colors (e.g., particularly with reference to FIG. 3). It should be understood that by varying materials, an intensity and/or duration of exposure to heat applied to materials, as well as other treatments and/or additives, the heat anodization process described herein can create colors over an almost infinite spectrum of colors. Thus, it should be understood that the illustrative colors illustrated and described herein with reference to FIG. 3 are merely illustrative of some variations in color that are possible, but that thousands, ten thousands, and/or even millions of possible colors and/or color combinations are possible via some embodiments of the heat anodization process illustrated and described herein. As such, it should be understood that the illustrated and described embodiments are merely illustrative and should not be construed as being limiting in any way.

Based on the foregoing, it should be appreciated that embodiments of a firearm suppressor with a heat anodization treatment have been disclosed herein. Although the subject matter presented herein has been described in conjunction with one or more particular embodiments and implementations, it is to be understood that the embodiments defined in the appended claims are not necessarily limited to the specific structure, configuration, or functionality described herein. Rather, the specific structure, configuration, and functionality are disclosed as example forms of implementing the claims.

The subject matter described above is provided by way of illustration only and should not be construed as limiting. Various modifications and changes may be made to the subject matter described herein without following the example embodiments and applications illustrated and described, and without departing from the true spirit and scope of the embodiments, which is set forth in the following claims.

I claim:

1. A firearm suppressor with a heat anodization treatment, the firearm suppressor comprising:

a firearm suppressor housing comprising an outer surface, an inner cavity that accommodates a baffle insert, and an attachment mechanism that is configured to attach the firearm suppressor housing to a barrel of a firearm, wherein the firearm suppressor housing is treated with a heat anodization process to create a design that is a part of the firearm suppressor housing, wherein the heat anodization process is completed using a plasma welding process and not using an open flame.

2. The firearm suppressor of claim 1, further comprising a baffle located within the inner cavity of the firearm suppressor housing.

3. The firearm suppressor of claim 1, wherein the firearm suppressor housing is formed from titanium.

4. The firearm suppressor of claim 1, wherein the firearm suppressor housing is formed from steel.

5. The firearm suppressor of claim 1, wherein the design comprises a pattern formed from a plurality of markings, and wherein the markings pass through a material used to form the outer surface and alter a structure and color of the material.

6. The firearm suppressor of claim 5, wherein the pattern comprises a pattern selected from a group of patterns consisting of:

a spiral pattern;

a camouflage pattern; and a worm pattern.

7. The firearm suppressor of claim 1, wherein the firearm suppressor housing has a finish applied on top of the design, the finish comprising one finish selected from a group of finishes consisting of:

a polished finish;

a satin finish;

a brushed finish;

a sandblasted finish; and a coating.

8. The firearm suppressor of claim 1, wherein the design passes through at least a portion of the firearm suppressor housing, and wherein the design alters a structure and color of a material metal used to form the firearm suppressor housing.

9. The firearm suppressor of claim 1, wherein the design passes through at least a portion of the firearm suppressor housing, and wherein the design alters a hardness of a material used to form the firearm suppressor housing.

10. The firearm suppressor of claim 1, wherein the design passes through at least a portion of the firearm suppressor housing, and wherein the design alters a tensile strength of a material used to form the firearm suppressor housing.

11. The firearm suppressor of claim 1, wherein the design is formed with a plasma welding device.

12. The firearm suppressor of claim 1, wherein the design affects a frequency of a sound emitted from the firearm suppressor.

13. A firearm suppressor with a heat anodization treatment, the firearm suppressor comprising:

a firearm suppressor housing formed from a metal, the firearm suppressor housing comprising an outer surface, an inner cavity that is configured to receive a baffle insert, and an attachment mechanism that is configured to attach the firearm suppressor housing to a barrel of a firearm, wherein the firearm suppressor housing is treated with a heat anodization process to create a design that is a part of the metal used to form the firearm suppressor housing, wherein the heat anodization process is completed using a plasma welding process and not using an open flame.

14. The firearm suppressor of claim 13, further comprising a baffle located within the inner cavity of the firearm suppressor housing.

15. The firearm suppressor of claim 13, wherein the baffle insert comprises a plurality of baffles, and wherein the baffle insert is located within the inner cavity of the firearm suppressor housing.

16. The firearm suppressor of claim 13, wherein the design comprises a pattern formed from a plurality of markings, and wherein the markings pass through at least a portion of the metal and alter a structure and color of the at least a portion of the metal.

17. The firearm suppressor of claim 13, wherein the firearm suppressor housing has a finish applied on top of the design, and wherein the design is permanently resistant to wear and corrosion by being a part of the metal.

18. A firearm suppressor with a heat anodization treatment, the firearm suppressor comprising:

a firearm suppressor housing formed from a metal, the firearm suppressor housing comprising an outer surface, an inner cavity housing a baffle insert, and an attachment mechanism that is configured to attach the firearm suppressor housing to a barrel of a firearm, wherein the firearm suppressor housing is treated with a heat anodization process to create a design, and wherein the design passes through at least a portion of the metal used to form the firearm suppressor housing and alters a structure and color of the metal, wherein the heat anodization process is completed using a plasma welding process and not using an open flame.

19. The firearm suppressor of claim 18, wherein the firearm suppressor housing comprises a surface finish that is applied on top of the design, and wherein the design is permanently resistant to wear and corrosion by being a part of the metal.

* * * * *